US011650543B2

(12) United States Patent
Charbon

(10) Patent No.: US 11,650,543 B2
(45) Date of Patent: May 16, 2023

(54) TITANIUM-BASED SPIRAL TIMEPIECE SPRING

(71) Applicant: Nivarox-FAR S.A., Le Locle (CH)

(72) Inventor: Christian Charbon, Chezard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 631 days.

(21) Appl. No.: 16/693,481

(22) Filed: Nov. 25, 2019

(65) Prior Publication Data

US 2020/0201254 A1 Jun. 25, 2020

(30) Foreign Application Priority Data

Dec. 21, 2018 (EP) ..... 18215265

(51) Int. Cl.
*C22C 14/00* (2006.01)
*G04B 1/14* (2006.01)
(Continued)

(52) U.S. Cl.
CPC ..... *G04B 1/145* (2013.01); *B21C 1/02* (2013.01); *C22C 14/00* (2013.01); *C22C 27/02* (2013.01); *C22F 1/183* (2013.01)

(58) Field of Classification Search
CPC . B21C 1/02; C22C 14/00; C22C 27/02; C22F 1/183; G04B 17/066; G04B 17/227; G04B 1/145
(Continued)

(56) References Cited

U.S. PATENT DOCUMENTS 6,402,859 B1 6/2002 Ishii et al.
6,607,693 B1 8/2003 Saito et al.
(Continued)

FOREIGN PATENT DOCUMENTS

CN 102713770 A 10/2012
EP 1 083 243 A2 3/2001
(Continued)

OTHER PUBLICATIONS

NPL: English abstractor JP-52147511 A, Dec. 1977 (Year: 1977).*
(Continued)

*Primary Examiner* — Jie Yang
(74) *Attorney, Agent, or Firm* — Oblon, McClelland, Maier & Neustadt, L.L.P.

(57) ABSTRACT

A spiral timepiece spring with a two-phase structure, made of a niobium and titanium alloy, and method for manufacturing this spring, including: producing a binary alloy containing niobium and titanium, with: niobium: the remainder to 100%; titanium: strictly greater than 60% and less than or equal to 85% by mass of the total, traces of components from among O, H, C, Fe, Ta, N, Ni, Si, Cu, Al; applying deformations alternated with heat treatments until a two-phase microstructure is obtained comprising a solid solution of niobium with β-phase titanium and a solid solution of niobium with α-phase titanium, the α-phase titanium content being greater than 10% by volume, wire drawing to obtain wire able to be calendered; calendering or insertion into a ring to form a mainspring, in a double clef shape before it is wound for the first time, or winding to form a balance spring.

24 Claims, 1 Drawing Sheet

(51) Int. Cl.

| | |
|---|---|
| ***B21C 1/02*** | (2006.01) |
| ***C22C 27/02*** | (2006.01) |
| ***C22F 1/18*** | (2006.01) |

(58) Field of Classification Search
USPC ..... 148/669
See application file for complete search history.

(56) References Cited

U.S. PATENT DOCUMENTS

| | | | |
|---|---|---|---|
| 2002/0174922 | A1 | 11/2002 | Ishii et al. |
| 2002/0180130 | A1 | 12/2002 | Baur et al. |
| 2007/0133355 | A1 | 6/2007 | Hara et al. |
| 2020/0308685 | A1 | 10/2020 | Laheurte et al. |

FOREIGN PATENT DOCUMENTS

| | | | |
|---|---|---|---|
| EP | 1 114 876 | B1 | 7/2001 |
| EP | 1 258 786 | B1 | 11/2002 |
| EP | 2 696 381 | A1 | 2/2014 |
| FR | 3 064 281 | A1 | 9/2018 |
| GB | 1166701 | | 10/1969 |
| JP | 52-147511 | | 12/1977 |
| WO | WO 2005/045532 | A2 | 5/2005 |
| WO | WO 2014/034766 | A1 | 3/2014 |
| WO | WO 2015/189278 | A3 | 12/2015 |
| WO | WO 2018/172164 | A1 | 9/2018 |

OTHER PUBLICATIONS

NPL: on-line translation of JP 52147511 A, Dec. 1977 (Year: 1977).*

European Search Report dated Jun. 26, 2019 in European Application 182152652 filed on Dec. 21, 2018 (witl English Translation of Categories of Cited Documents).

Japanese Office Action dated Nov. 17, 2020 in Japanese Patent Appiication No. 2019-212905 (with English translation), 14 pages.

Indian Office Action dated Nov. 1, 2021 in Indian Patent Application No. 201944052280 (with English translation), 6 pages.

Combined Chinese Office Action and Search Report dated Oct. 28, 2021 in Chinese Patent Application No. 201911326726.3 (with English translation of Categories of Cited Documents), 13 pages.

Feng Yi, "Metal Material Science" National Defense Industry Press, Apr. 30, 2009, pp. 209-211 and cover pages.

Combined Chinese Office Action and Search Report dated Apr. 2, 2021 in Patent Application No. 201911326726.3 (with English language translation and English translation of Category of Cited Documents), 12 pages.

Final Decision of Rejection dated Apr. 13, 2021 in Japanese Patent Application No. 2019-212905 (with English language translation), 8 pages.

Zeng Liying, et al., "Progress in High Strength Titanium Alloys for Springs," Titanium Industry Progress, vol. 26, No. 5, Oct. 2009, 7 pages (with English Abstract).

* cited by examiner

TITANIUM-BASED SPIRAL TIMEPIECE SPRING

CROSS-REFERENCE TO RELATED APPLICATION

This application claims priority to European Patent Application No. 18215265.2 filed on Dec. 21, 2018, the entire disclosure of which is hereby incorporated herein by reference.

FIELD OF THE INVENTION

The invention concerns a spiral timepiece spring, particularly a mainspring or a balance spring, with a two-phase structure.

The invention also concerns a method for manufacturing a spiral timepiece spring.

The invention concerns the field of manufacturing timepiece springs, in particular energy storage springs, such as mainsprings or motor springs or striking-work springs, or oscillator springs, such as balance springs.

BACKGROUND OF THE INVENTION

The manufacture of energy storage springs for horology is subject to constraints that often seem incompatible at first sight:

- the need to obtain a very high elastic limit,
- the need to obtain a low modulus of elasticity,
- ease of manufacture, particularly of wire drawing,
- excellent fatigue resistance,
- durability,
- small cross-sections,
- arrangement of the ends: core hook and slipspring, with local weaknesses and difficulty in manufacture.

The production of balance springs is centred on the concern for temperature compensation, so as to ensure regular chronometric performance. This requires obtaining a thermoelastic coefficient that is close to zero.

Any improvement on at least one of these points, and in particular on the mechanical strength of the alloy used, thus represents a significant advance.

SUMMARY OF THE INVENTION

The invention proposes to define a new type of spiral timepiece spring, based on the selection of a particular material, and to develop the appropriate manufacturing method.

To this end, the invention concerns a spiral timepiece spring with a two-phase structure according to claim 1.

The invention also concerns a method for manufacturing such a spiral timepiece spring according to claim 10.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
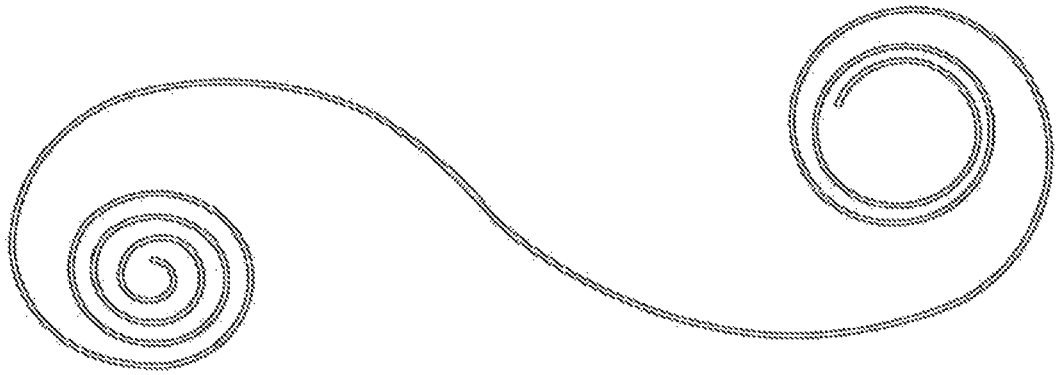
FIG. 1 represents a schematic, plan view of a mainspring, which is a spiral spring according to the invention, before it has been wound for the first time.
Figure 2:
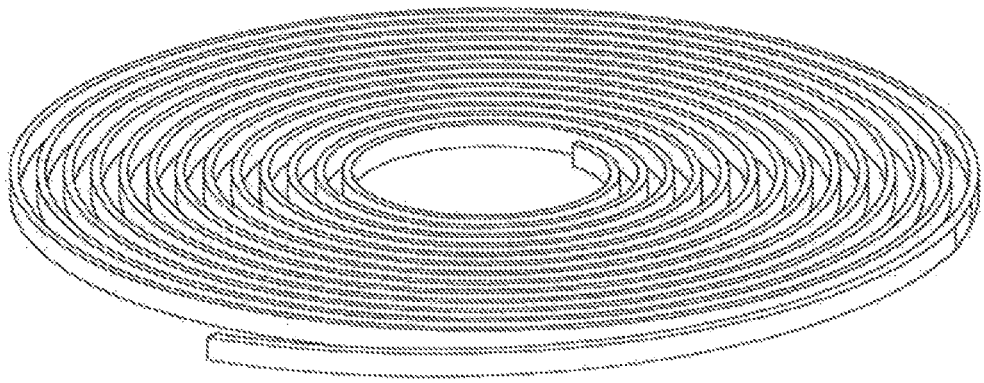
FIG. 2 represents a schematic view of a balance spring, which is a spiral spring according to the invention.
Figure 3:
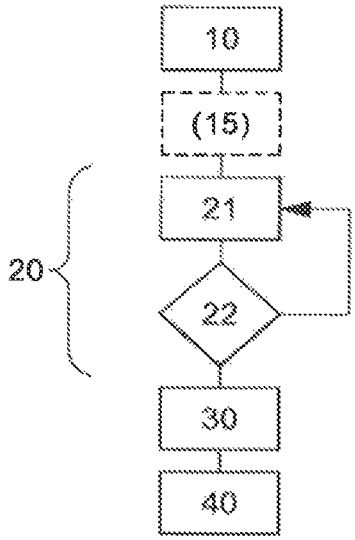
FIG. 3 represents the sequence of main operations of the method according to the invention.

The invention concerns a spiral timepiece spring with a two-phase structure.

According to the invention, the material of this spiral spring is a titanium-based binary alloy containing niobium.

In an advantageous variant embodiment, this alloy contains:

- niobium: the remainder to 100%;
- a proportion by mass of titanium strictly greater than 60.0% of the total and less than or equal to 85.0% of the total,
- traces of other components from among O, H, C, Fe, Ta, N, Ni, Si, Cu, Al, each of said trace components being comprised between 0 and 1600 ppm by mass of the total, and the sum of these traces being less than or equal to 0.3% by mass.

More particularly, this alloy includes a proportion by mass of titanium that is greater than or equal to 65.0% of the total and less than or equal to 85.0% of the total.

More particularly, this alloy includes a proportion by mass of titanium that is greater than or equal to 70.0% of the total and less than or equal to 85.0% of the total.

More particularly still, in an alternative, this alloy includes a proportion by mass of titanium that is greater than or equal to 70.0% of the total and less than or equal to 75.0% of the total.

More particularly still, in another alternative, this alloy includes a proportion by mass of titanium that is strictly greater than or equal to 76.0% of the total and less than or equal to 85.0% of the total.

More particularly, this alloy includes a proportion by mass of titanium that is less than or equal to 80.0% of the total.

More particularly still, this alloy includes a proportion by mass of titanium that is strictly greater than 76.0% of the total and less than or equal to 78.0% of the total.

Advantageously, this spiral spring has a two-phase microstructure containing β-phase body-centred cubic niobium and α-phase hexagonal close packed titanium. More particularly, this spiral spring has a two-phase structure comprising a solid solution of niobium with β-phase titanium (body-centred cubic structure) and a solid solution of niobium with α-phase titanium (hexagonal close packed structure), wherein the α-phase titanium content is greater than 10% by volume.

To obtain a structure of this type that is suitable for producing a spring, part of the α-phase must be precipitated by heat treatment.

The higher the titanium content, the higher the maximum proportion of α-phase that can be precipitated by heat treatment, which is an incentive to seek a high proportion of titanium.

More particularly, the total proportion by mass of titanium and niobium is comprised between 99.7% and 100% of the total.

More particularly, the proportion by mass of oxygen is less than or equal to 0.10% of the total, or less than or equal to 0.085% of the total.

More particularly, the proportion by mass of tantalum is less than or equal to 0.10% of the total.

More particularly, the proportion by mass of carbon is less than or equal to 0.04% of the total, in particular less than or equal to 0.020% of the total, or less than or equal to 0.0175% of the total.

More particularly, the proportion by mass of iron is less than or equal to 0.03% of the total, in particular less than or equal to 0.025% of the total, or less than or equal to 0.020% of the total.

More particularly, the proportion by mass of nitrogen is less than or equal to 0.02% of the total, in particular less than or equal to 0.015% of the total, or less than or equal to 0.0075% of the total.

More particularly, the proportion by mass of hydrogen is less than or equal to 0.01% of the total, in particular less than or equal to 0.0035% of the total, or less than or equal to 0.0005% of the total.

More particularly, the proportion by mass of nickel is less than or equal to 0.01% of the total.

More particularly, the proportion by mass of silicon is less than or equal to 0.01% of the total.

More particularly, the proportion by mass of nickel is less than or equal to 0.01% of the total, in particular less than or equal to 0.16% of the total.

More particularly, the proportion by mass of ductile material or copper is less than or equal to 0.01% of the total, in particular less than or equal to 0.005% of the total.

More particularly, the proportion by mass of aluminium is less than or equal to 0.01% of the total.

This spiral spring has an elastic limit higher than or equal to 1000 MPa.

More particularly, the spiral spring has an elastic limit higher than or equal to 1500 MPa.

More particularly still, the spiral spring has an elastic limit higher than or equal to 2000 MPa.

Advantageously, this spiral spring has a modulus of elasticity higher than 60 GPa and less than or equal to 80 GPa.

Depending on the treatment applied during manufacture, the alloy thus determined allows the production of spiral springs which are balance springs with an elastic limit higher than or equal to 1000 MPa, or mainsprings, particularly when the elastic limit is higher than or equal to 1500 MPa.

Application to a balance spring requires properties that can ensure chronometric performance is maintained despite the variation in temperature during use of a watch incorporating such a balance spring. The thermoelastic coefficient, (TEC in English) of the alloy, is therefore of great importance. The cold-worked β-phase of the alloy has a strongly positive thermoelastic coefficient, and precipitation of the α-phase that has a strongly negative thermoelastic coefficient allows the two-phase alloy to be brought to a thermoelastic coefficient close to zero, which is particularly advantageous. To form a chronometric oscillator with a balance made of CuBe or of nickel silver, a thermoelastic coefficient of +/−10 ppm/° C. must be attained. The formula that links the thermoelastic coefficient of the alloy and the expansion coefficients of the balance spring and the balance is as follows:

$$CT = \frac{dM}{dT} = \left(\frac{1}{2E}\frac{dE}{dT} - \beta + \frac{3}{2}\alpha\right) \times 86400 \frac{s}{j^{\circ}\ C.}$$

Variables M and T are respectively rate and temperature. E is the Young's modulus of the balance spring, and, in this formula, E, β and α are expressed in ° C.$^{-1}$.

CT is the temperature coefficient of the oscillator (usually TC in English), (1/E·dE/dT) is the thermoelastic coefficient of the balance spring alloy, β is the expansion coefficient of the balance and α that of the balance spring.

The invention further concerns a method for manufacturing a spiral timepiece spring, characterized in that the following steps are implemented in succession:

(10) producing a blank from an alloy containing niobium and titanium, which is a binary titanium-based alloy containing niobium, and which contains:

niobium: the remainder to 100%;

a proportion by mass of titanium strictly greater than or equal to 60.0% of the total and less than or equal to 85.0% of the total, traces of other components from among O, H, C, Fe, Ta, N, Ni, Si, Cu, Al, each of said trace components being comprised between 0 and 1600 ppm by mass of the total, and the sum of said traces being less than or equal to 0.3% by mass;

(20) applying to said alloy pairs of deformation/precipitation heat treatment sequences, comprised of the application of deformations alternated with heat treatments, until a two-phase microstructure is obtained comprising a solid solution of niobium with β-phase titanium and a solid solution of niobium with α-phase titanium, the α-phase titanium content being greater than 10% by volume, with an elastic limit higher than or equal to 1000 MPa, and a modulus of elasticity higher than 60 GPa and less than or equal to 80 GPa;

(30) wire drawing to obtain a wire of round cross-section, and rectangular profile unformed rolling compatible with the entry cross-section of a roller press or of a winder arbor or, in the case of a mainspring, ready to be wound and inserted in a ring for further treatment operations;

(40) forming coils in the shape of a treble clef to form a mainspring prior to its first winding, or winding to form a balance spring, or insertion in a ring and heat treatment to form a mainspring.

In particular, there is applied to this alloy pairs of deformation/precipitation heat treatment sequences 20 comprising the application of deformations (21) alternated with heat treatments (22), until a two-phase microstructure is obtained comprising a solid solution of niobium with β-phase titanium and a solid solution of niobium with α-phase titanium, the α-phase titanium content being greater than 10% by volume, with an elastic limit higher than or equal to 2000 MPa. More particularly, the treatment cycle in this case includes a prior beta quenching treatment (15) at a given diameter, such that the entire structure of the alloy is beta, then a succession of the pairs of deformation/precipitation heat treatment sequences.

In these pairs of deformation/precipitation heat treatment sequences, each deformation is carried out with a given deformation rate comprised between 1 and 5, wherein the deformation rate answers the conventional formula 2ln(d0/d), where d0 is the diameter of the last beta quenching, and where d is the diameter of the cold worked wire. The overall accumulation of deformations over the entire succession of phases gives a total deformation rate comprised between 1 and 14. Every pair of deformation/precipitation heat treatment sequences includes, each time, a precipitation heat treatment of the α-phase Ti (300-700° C., 1 h-30 h).

This variant of the method including beta quenching is particularly suited to the manufacture of mainsprings. More particularly, this beta quenching is a solution treatment, with a duration comprised between 5 minutes and 2 hours at a temperature comprised between 700° C. and 1000° C., under vacuum, followed by gas cooling.

More particularly still, the beta quenching is a solution treatment, with 1 hour at 800° C. under vacuum, followed by gas cooling.

Returning to the pairs of deformation/precipitation heat treatment sequences, more particularly each pair of deformation/precipitation heat treatment sequences includes a precipitation heat treatment of a duration comprised between 1 hour and 80 hours at a temperature comprised between 350° C. and 700° C. More particularly, the duration is comprised between 1 hour and 10 hours at a temperature comprised between 380° and 650° C. More particularly still, the duration is from 1 hour to 12 hours, at a temperature of 380° C. Preferably, long heat treatments are applied, for example heat treatments performed for a duration comprised between 15 hours and 75 hours at a temperature comprised between 350° C. and 500° C. For example, heat treatments are applied from 75 hours to 400 hours at 350° C., for 25 hours at 400° C. or for 18 hours at 480° C.

More particularly, the method includes between one and five, and preferably from three to five, pairs of deformation/precipitation heat treatment sequences.

More particularly, the first pair of deformation/precipitation heat treatment sequences includes a first deformation with at least a 30% reduction in cross-section.

More particularly, each pair of deformation/precipitation heat treatment sequences, apart from the first, includes one deformation between two precipitation heat treatments with at least a 25% reduction in cross-section.

More particularly, after producing said alloy blank, and prior to wire drawing, in an additional step 25, a surface layer of ductile material is added to the blank, chosen from among copper, nickel, cupronickel, cupro manganese, gold, silver, nickel-phosphorus Ni—P and nickel-boron Ni—B, or similar, to facilitate shaping by drawing, wire drawing and unformed rolling, After wire drawing, or after unformed rolling, or after a subsequent calendering, pressing or winding operation, or insertion in a ring and heat treatment in the case of a mainspring, the layer of ductile material is removed from the wire, particularly by etching, in a step 50.

For the mainspring, it is, in fact, possible to perform the manufacturing by insertion in a ring and heat treatment, where the insertion in a ring replaces calendering. The mainspring is generally also heat treated after insertion in a ring or after calendering.

A balance spring is generally also heat treated after winding.

More particularly, the last deformation phase takes the form of flat unformed rolling, and the last heat treatment is performed on the spring that has been rolled or inserted in a ring or wound. More particularly, after wire drawing, the wire is rolled flat, before the actual spring is produced by calendering or winding or insertion in a ring.

In a variant, the surface layer of ductile material is deposited to form a balance spring whose pitch is not a multiple of the thickness of the strip. In another variant, the surface layer of ductile material is deposited to form a spring whose pitch is variable.

In a particular horological application, ductile material or copper, is thus deposited at a given time to facilitate the shaping of the wire by drawing and wire drawing, so that there remains a thickness of 10 to 500 micrometres on the wire at the final diameter of 0.3 to 1 millimetre. The layer of ductile material or copper is removed from the wire, particularly by etching, and is then rolled flat before the actual spring is produced.

The addition of ductile material or copper may be a galvanic or mechanical process, it is then a sleeve or tube of ductile material or copper which is fitted to a niobium-titanium alloy bar with a rough diameter, and then thinned out during the steps of deforming the composite bar.

The layer can be removed, in particular by etching, with a cyanide or acid based solution, for example nitric acid.

The invention thus makes it possible to produce a spiral mainspring made of a niobium-titanium alloy, typically with 60% by mass of titanium.

With a suitable combination of deformation and heat treatment steps, it is possible to obtain a very thin, lamellar, two-phase microstructure (particularly a nanometric microstructure), comprising a solid solution of niobium with β-phase titanium and a solid solution of niobium with α-phase titanium. α-phase titanium content being greater than 10% by volume. This alloy combines a very high elastic limit, at least higher than 1000 MPa, or higher than 1500 MPa, or even 2000 MPa for the wire, and a very low modulus of elasticity, on the order of 60 GPa to 80 GPa. This combination of properties is very suitable for a mainspring or a balance spring. This niobium-titanium alloy can easily be coated with ductile material or copper, which greatly facilitates deformation by wire drawing.

Such an alloy is known and used for the manufacture of superconductors, such as magnetic resonance imaging devices, or particle accelerators, but is not used in horology. Its thin, two-phase microstructure is desired in the case of superconductors for physical reasons and has the welcome side effect of improving the mechanical properties of the alloy.

Such an alloy is particularly suitable for producing a mainspring, and also for producing balance springs.

A binary alloy containing niobium and titanium, of the type mentioned above for implementation of the invention, is also capable of being used as a spiral wire; it has a similar effect to that of Elinvar, with a virtually zero thermoelastic coefficient within the usual operating temperature range of watches, and is suitable for the manufacture of temperature compensating balance springs, in particular for niobium-titanium alloys with a proportion by mass of titanium of 60% and up to 85%.

The invention claimed is:

1. A spiral timepiece spring with a two-phase structure, wherein the material of the spiral timepiece spring is a binary titanium-based alloy comprising:

niobium with a remainder to 100%;

titanium in a range of from greater than 60.0 to no more than 85.0% by mass of total alloy mass; and traces of other components from among O, H, C, Fe, Ta, N, Ni, Si, Cu, Al, each trace component except O being present in a range of from 0 to 1600 ppm by mass of the total alloy mass, O being present in a range of from 0 to 0.085% by mass, and the sum of the traces being less than or equal to 0.3% by mass.

2. The timepiece spiral spring of claim 1, wherein the alloy comprises the titanium in a range of from 65.0 to 85.0% of the total alloy mass.

3. The timepiece spiral spring of claim 2, wherein the alloy comprises the titanium in a range of from 70.0 to 85.0% of the total alloy mass.

4. The spiral timepiece spring of claim 3, wherein the alloy comprises the titanium in a range of from greater than 76.0 to no more than 85.0% of the total alloy mass.

5. The spiral timepiece spring of claim 1, wherein the alloy comprises the titanium in a range of from greater than 60.0 to no more than 80.0% of the total alloy mass.

6. The spiral timepiece spring of claim 1, wherein a total proportion by mass of titanium and niobium is in a range of from 99.7% to 100% of the total alloy mass.

7. The spiral timepiece spring of claim 1, having a two-phase microstructure comprising a solid solution of niobium with β-phase titanium and a solid solution of niobium with α-phase titanium, the α-phase titanium content being greater than 10% by volume.

8. The spiral timepiece spring of claim 1, which is a mainspring.

9. The spiral timepiece spring of claim 1, which is a balance spring.

10. The spiral spring of claim 1, wherein the alloy has an elastic modulus in a range of from 60 to 80 GPa and an elastic limit of at least 1000 MPa.

11. A method for manufacturing the spiral timepiece spring of claim 1, the method comprising, in succession:

producing a blank from a binary alloy comprising niobium and titanium, the blank comprising:

niobium: the remainder to 100%:

a proportion by mass of titanium greater than or equal to 60.0% of the total and less than or equal to 85.0% of the total, traces of other components from among O, H, C, Fe, Ta, N, Ni, Si, Cu, Al, each of the trace components being comprised in a range of from 0 to 1600 ppm by mass of the total, O being present in a range of from 0 to 0.085% by mass, and the sum of the traces being less than or equal to 0.3% by mass;

performing a treatment cycle comprising a prior beta quenching treatment at a given diameter, such that the entire structure of the alloy is beta, then applying to the alloy a succession of pairs of deformation/precipitation heat treatment sequences, comprising applying deformations alternating with heat treatments until a two-phase microstructure is obtained comprising a solid solution of niobium with β-phase titanium and a solid solution of niobium with α-phase titanium, the α-phase titanium content being greater than 10% by volume, with an elastic limit higher than or equal to 1000 MPa, and a modulus of elasticity higher than 60 GPa and less than or equal to 80 GPa;

wire drawing to obtain a wire of round cross-section, and rectangular profile unformed rolling compatible with the entry cross-section of a roller press or of a winder arbor or with insertion in a ring; and forming coils in the shape of a treble clef to form a mainspring prior to its first winding, or winding to form a balance spring, or insertion in a ring and heat treatment to form a mainspring.

12. The method of claim 11, wherein a final deformation phase is carried out in the form of flat unformed rolling, and wherein the last heat treatment is performed on the spring that has been calendered or inserted in a ring or wound.

13. The method of claim 11, wherein the alloy is subjected to pairs of deformation/precipitation heat treatment sequences, comprising applying deformations alternating with heat treatments, until a two-phase microstructure is obtained comprising a solid solution of niobium with β-phase titanium and a solid solution of niobium with α-phase titanium, the α-phase titanium content being greater than 10% by volume, with an elastic limit greater than or equal to 2000 MPa, the treatment cycle comprising a prior beta quenching treatment at a given diameter, such that the entire structure of the alloy is beta, then a succession of the pairs of deformation/precipitation heat treatment sequences, wherein each deformation is performed with a given deformation rate in a range of from 1 to 5, the overall accumulation of deformations over the entire series of phases giving a total deformation rate in a range of from 1 to 14, and which each time comprises a precipitation heat treatment of the α-phase Ti.

14. The method of claim 13, wherein the beta-quenching is a solution treatment, with a duration in a range of from 5 minutes to 2 hours at a temperature in a range of from 700 to 1000° C., under vacuum, followed by gas cooling.

15. The method of claim 14, wherein the beta-quenching is a solution treatment, with 1 hour at 800° C., under vacuum, followed by gas cooling.

16. The method of claim 11, wherein each pair of deformation/precipitation heat treatment sequences comprises a precipitation treatment with a duration in a range of from 1 to 80 hours at a temperature in a range of from 350 to 700° C.

17. The method of claim 16, wherein each pair of deformation/precipitation heat treatment sequences comprises a precipitation treatment with a duration in a range of from 1 to 10 hours at a temperature in a range of from 380 to 650° C.

18. The method of claim 17, wherein each pair of deformation/precipitation heat treatment sequences comprises a precipitation treatment with a duration in a range of from 1 to 12 hours at 450° C.

19. The method of claim 11, comprising 1 to 5 of the pairs of deformation/precipitation heat treatment sequences.

20. The method of claim 11, wherein a first pair of deformation/precipitation heat treatment sequences comprises a first deformation with an at least 30% reduction in cross-section.

21. The method of claim 20, wherein each of the pair of deformation/precipitation heat treatment sequences, apart from the first, comprises one deformation between two precipitation heat treatments with at least a 25% reduction in cross-section.

22. The method of claim 11, wherein, after producing the alloy blank, and prior to the wire drawing, a surface layer of ductile material is added to the blank, the ductile material comprising copper, nickel, cupronickel, cupro manganese, gold, silver, nickel-phosphorus Ni—P and nickel-boron Ni—B, or similar, to facilitate shaping of the wire by drawing, wire drawing and unformed rolling, and in that, after the wire drawing, or after the unformed rolling, or after a subsequent calendering or winding or insertion in a ring operation, the layer of ductile material is removed from the wire by etching.

23. The method of claim 22, wherein, after the wire drawing, the wire is rolled flat, before the actual spring is produced by calendering or winding or insertion in a ring.

24. The method of claim 22, wherein the surface layer of ductile material is deposited to form a spring whose pitch is constant and is not a multiple of the thickness of the strip.

* * * * *